United States Patent [19]

Geiger

[11] Patent Number: 4,599,814

[45] Date of Patent: Jul. 15, 1986

[54] METHOD AND EQUIPMENT FOR MANGLING WET LAUNDRY

[75] Inventor: Friedrich Geiger, Todtenweis, Fed. Rep. of Germany

[73] Assignee: Kleindienst GmbH, Augsburg, Fed. Rep. of Germany

[21] Appl. No.: 619,152

[22] PCT Filed: Oct. 3, 1983

[86] PCT No.: PCT/EP83/00257

§ 371 Date: Jun. 4, 1984

§ 102(e) Date: Jun. 4, 1984

[87] PCT Pub. No.: WO84/01395

PCT Pub. Date: Apr. 12, 1984

[30] Foreign Application Priority Data

Oct. 5, 1982 [DE] Fed. Rep. of Germany ..... 3236870

[51] Int. Cl.[4] ..... D06F 65/10; D06F 71/34

[52] U.S. Cl. ..... 38/51; 38/2; 38/14; 38/55; 34/86

[58] Field of Search ..... 38/2, 3, 49, 51, 54, 38/55, 8, 9, 14, 56, 18, 44; 34/86

[56] References Cited

U.S. PATENT DOCUMENTS

| | | | |
|---|---|---|---|
| 3,011,266 | 12/1961 | Fleissner | 38/14 |
| 4,236,330 | 12/1980 | Theiler | 38/14 |
| 4,275,510 | 6/1981 | George | 34/86 |
| 4,414,765 | 11/1983 | Kreinberg | 38/54 |
| 4,454,668 | 6/1984 | Krauss et al. | 38/55 |

FOREIGN PATENT DOCUMENTS

| | | | |
|---|---|---|---|
| 55416 | 5/1890 | Fed. Rep. of Germany . | |
| 193037 | 8/1905 | Fed. Rep. of Germany . | |
| 687248 | 12/1939 | Fed. Rep. of Germany . | |
| 1937738 | 2/1971 | Fed. Rep. of Germany . | |
| 1610233 | 3/1971 | Fed. Rep. of Germany . | |
| 1760807 | 1/1972 | Fed. Rep. of Germany . | |
| 2407545 | 8/1975 | Fed. Rep. of Germany | 38/8 |
| 3044229 | 6/1982 | Fed. Rep. of Germany . | |
| 1025851 | 4/1902 | France . | |
| 1012295 | 1/1955 | France . | |
| 60786 | 1/1955 | France . | |
| 7930419 | 6/1981 | France . | |
| 346519 | 7/1960 | Switzerland . | |
| 410522 | 5/1934 | United Kingdom . | |

*Primary Examiner*—Werner H. Schroeder
*Assistant Examiner*—Andrew M. Falik
*Attorney, Agent, or Firm*—Karl F. Ross; Herbert Dubno

[57] ABSTRACT

In the case of common trough mangles (1) used for the smoothing and drying of wet laundry pieces (11) wherein the hollow rollers (2) provided with roller wrappings (3) are only partially surrounded by heated pressing troughs (4, 5), a considerable amount of energy is wasted due to the absorption of cooler room air. In order to eliminate the cause of this deficiency, the invention proposes to cover the free area of the hollow roller (2) with a hood (6), whose rims (9) are sealed against the roller wrapping (3). The exhaust (8) of the steam is removed directly from the hood (6). This way, inside the hood (6) clean saturated steam is obtained and superheated, when the absorption from the hood (6) takes place in counterflow with regard to the travel of the laundry pieces (11). This superheated saturated steam is especially suitable as operating means for washing machines or the like.

17 Claims, 5 Drawing Figures

METHOD AND EQUIPMENT FOR MANGLING WET LAUNDRY

CROSS REFERENCE TO RELATED APPLICATIONS

This application is a National Phase Application corresponding to PCT/EP/83/00257 filed Oct. 3, 1983 and based upon German application No. P 32 36 870.4 filed Oct. 5, 1982 under the International Convention.

FIELD OF THE INVENTION

The invention relates to methods and devices for mangling wet laundry which is conveyed between at least one hollow roller, provided with a roller wrapping and which can be perforated and connected to an exhaust installation, and a heated bearing surface in the shape of a trough-shaped hollow body wherein the bearing surface encompasses only one portion of the hollow roller, the other portion being covered by a hood, sealed with respect to the roller wrapping.

BACKGROUND OF THE INVENTION

In the trough mangles existing on the market the padded hollow roller is encompassed by the bearing surfaces over an arc of its circumference of at least 165°. During the drying of the laundry, the resulting steam is evacuated by a frontally attached blower through the roller wrapping as well as through a multitude of holes in the steel wall of the hollow roller. These blowers have to be arranged to handle the steam generated by a maximum mangling load. Since the blowers are dimensioned with a safety factor with relation to the delivery (negative pressure) and discharge, even with maximum mangling loads a negative pressure can prevail inside the hollow roller (pressing roller) which results in the intake of cool room air through the free surface of the roller wrapping not covered by the bearing surfaces. The free surface comprises approximately 195° of arc of the roller wall.

If the mangling is performed with little laundry or with interruptions when there is no laundry to be pressed, then, due to the exhaust resulting from the rotational speed of the hollow roller, energy is wasted. In this case, air at room temperature is drawn in through the turning hollow roller, cools it on its way to discharge from the pressing trough to the reentry and the drying speed is reduced by approximately 10–15% while additional energy in the form of steam must be fed to the pressing trough as required for heating this air.

It is therefore required for 1 kg laundry having a normal residual moisture at the mangling loading rate of 40 to 60% which is common in practice to provide an amount of steam of 1.2 kg or more for heating the mangle. The thermal efficiency is consequently in the range of 50% or less.

Numerous proposals aimed at reducing the energy consumption in such common mangles have been published. For instance it has been proposed to cover the roller wrapping with a shell extending at a distance of approximately 3 cm from the surface of the roller wrapping and parallel thereto. This can affect only a slight reduction in energy consumption because the heating of the room air at the hot surfaces on the upper side of the mangle heat radiation are reduced.

Due to the fact that the shell is positioned at a distance from the roller wrapping it is possible for equal amounts of the room air, as in the fully open pressing roller, to be drawn in through the larger slots at the entrance and exit ends having a cross section of approximately 1 sqm. This room air will then be unnecessarily blown out as hot air. Since the cross section of the suction connection on the pressing roller is considerably smaller than the cross section of the mentioned slots, the surface of the pressing roller is disadvantageously provided with room air.

The German open application No. 19 37 738 tries to eliminate this disadvantage proposing that the feed- and discharge-end rims of a shell shaped as a hood with reflector be sealed opposite to the roller wrapping. Since the steam generated during mangling must be exhausted from the drum axially, the construction of heat-resistant bearings of a larger diameter and the high cost related thereto are unavoidable. The sealing of the hood against the roller wrapping leads to work interruptions and the related drops in temperature to corrosion, requiring considerable added expenses for adequate countermeasures to avoid that.

OBJECT OF THE INVENTION

The object of the invention is to achieve energy savings in an economical way and to utilize the saved energy in a method and apparatus for mangling wet laundry.

SUMMARY OF THE INVENTION

This object is attained through the method according to the invention, in that the steam originating from the laundry or the roller wrapping while passing the bearing surface is led into the interior of the hood and is therefrom evacuated through an exhaust device directly attached to the hood.

A particular embodiment of the invention, which can be an independent feature in itself, consists in that the saturated steam resulting at the mangle is conveyed with the best possible exclusion of air admixture and used as an operating medium at the washing machines of the laundry, for their direct heating, with the aid of compression and in some cases with the aid of periodic superheating.

The invention is based on the concept that basic energy savings are obtainable by eliminating as much as possible the intake of fresh air through the free surface of the hollow roller not surrounded by the pressing trough. If the free surface is surrounded by the sealed hood according to the invention and connected to the exhaust installation, the output of the blower can be reduced to 60% of that otherwise required. The evacuation of the steam produced during drying can be carried out therefore directly from the hood, since in the case of the common springpressor elastopress flexible wrapping of the hollow cylinder a sufficiently large exhaust cross section exists between the fabric coating and roller shell. Therefore it is possible to leave the shell of the roller without holes. On the contrary, if a perforated roller shell without axial suction connections is used, the absorption of the steam through the hood is further facilitated. Since the direct suction according to the invention is almost only used to eliminate the steam produced during drying and for this purpose a 5 to 7 times larger cross section is available, the negative pressure produced by the blower can be significantly reduced, namely to about 35% of the present negative pressure.

Consequently, a low-pressure blower can be installed with the advantage that when the mangle runs without load and also when the amount of steam is equal to 0, less infiltrated air is absorbed through the free roller surface which remains between the hood and the pressing trough.

A considerable cost saving also results from the fact that in the case of the commonly known installation the usual axial connection of the exhaust to the hollow shaft of the hollow roller is superfluous, which allows for smaller less expensive bearings for the hollow roller.

An advantage of a different kind regarding the direct abstraction of the steam from the hood arises from the fact that the steam generated in the trough area penetrates the textile material at the outer surface of the wrapping from the exterior towards the interior and escapes again from the interior towards the exterior in the hood area. This alternate flow through the textile material keeps its pores open remarkably longer. In the mangles known in the art the air is always directed from the exterior to the interior through the finishing textile, which results in a filtering effect for room air rich in lint and dust particles. Consequently the finishing wrapping becomes more dense with increased operation time and eventually steamproof, necessitating more frequent washing. These disadvantages are eliminated by the invention.

Up to now, the prevailing concept in the field was that it was necessary to feed to the mangle certain amounts of air in order to dry the covering of the roller wrapping and then to be able to carry away the steam generated in the mangle. Even the newest proposals (open German application Nos. 30 44 229, 31 23 886, 32 09 365) deal with various possible solutions for supplying the mangle with air.

The invention makes a clean break with these earlier solutions by trying to keep the air away or even to eliminate it completely in order to keep the steam generated in the mangle as clean as possible and to utilize it. Since steam is absorbed at the entrance side of the hood, there is already superheated steam at this point, while at the opposite side of the hood saturated steam is still available. The superheating of the steam results advantageously from the countercurrent movement whereby the laundry passes the mangle in a counterflow with respect to the steam absorption flow. The saturated steam originally generated in the mangle during its countercurrent absorption movements sweeps heated metal parts of the rollers, troughs, and the hood, thereby becoming superheated, which again leads to the drying of the roller coverings with overheated steam. Surprisingly it has been proven this way that there is no need for air either as a drying or as a conveying means and indeed an air supply would be rather damaging.

In the concept of one of the embodiments of the invention, the superheated steam generated during mangling utilized according to the invention, is supplied to the washing machines as a direct heating medium which can also be superheated.

A comparative energy calculation has shown that by supplying the washing machine and the mangle with steam, approximately 50% fresh steam can be saved when the washing machine is supplied with superheated steam produced during mangling.

In conclusion, by applying the method in accordance with the invention, the drying speed is increased, the energy saving considerably improved and the thermal efficiency rate significantly increased. A considerably shorter heat-up time of the mangle with less energy consumption results. The heat transfer to the room is remarkably decreased, as is its idling consumption. In order to achieve these savings it is not necessary to use the expensive heat exchangers required by the current state of the art.

BRIEF DESCRIPTION OF THE DRAWING

Embodiments of the invention are represented schematically in the drawing, in which.

SPECIFIC DESCRIPTION

Figure 1:
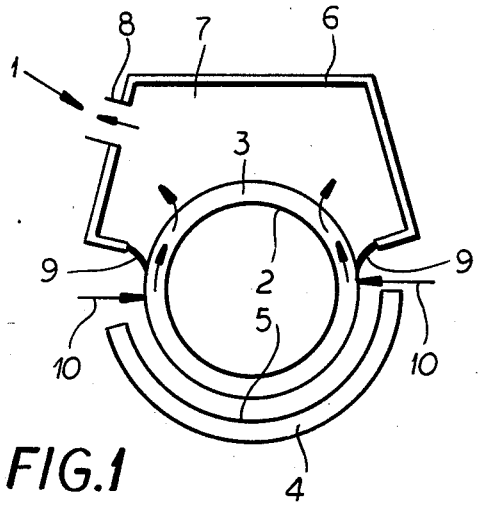
FIG. 1 is a diagrammatic cross section through a mangle trough with hood under no-load conditions.

The basic concept of the invention is illustrated in FIG. 1, with a trough mangle 1. This has a rotatable hollow cylinder 2 which does not have to have any roller perforations, but can also be provided with one such perforation. This hollow roller 2 is surrounded by a yieldable, steam permeable roller wrapping 3, shaped in the usual manner. A portion of the roller wrapping 3 is encompassed by a trough shaped hollow body 4, having a heated working surface 5 through which the thermal energy needed for the drying and smoothing of the laundry 11 is provided.

The portion of the hollow cylinder 2, respectively of its roller wrapping 3 which is not encompassed by or juxtaposed with the trough-shaped hollow body 4 is surrounded by a hood 6, whose interior space 7 is sealed with respect to roller wrapping 3 by means of the seals 9. An exhaust connection 8 is attached to the hood 6.

As shown in FIG. 1, the room air can reach the roller wrapping 3 only in the most minimal amounts along the narrow air duct 10 and from there through the interior of the roller wrapping the air can reach the inner space 7 of the hood 6 and from there can be absorbed. It is therefore enough to have only a low pressure blower to keep the infiltrated air away from entering the free space of the roller surface between the hood 6 and the trough 4, while the mangle is in no-load condition and steam is not generated.

Figure 2:
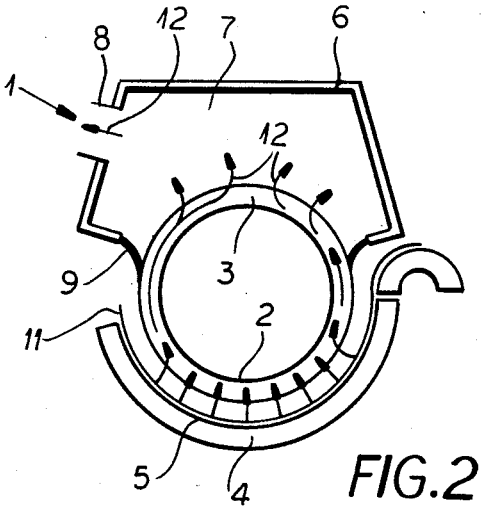
FIG. 2 is a cross section of the apparatus of FIG. 1 with introduced laundry.

If, on the contrary, a piece of laundry 11 is processed, as shown in FIG. 2, practically only a negligible amount of infiltrated air is drawn in. Instead the steam generated by the heating of the piece of laundry 11 at the working surface 5 is abstracted in the direction of the flow indicated by arrows 12 from the inner space of roller wrapping 3, from where the steam due to its expansion easily reaches the inner space 7 of the hood 6 and from there said steam is drawn through the exhaust 8. If the shell of the hollow roller 2 is perforated, the flow takes place also in a somewhat radial direction through the hollow roller 2.

In the case of equal pressure or even slight overpressure in the hood 6 with respect to its surroundings it is possible to eliminate completely the infiltrated air. The blower is then so adjusted (as to the number of rotations) that with different steam amounts the pressure in the mangle can be maintained at the same level.

Figure 3:
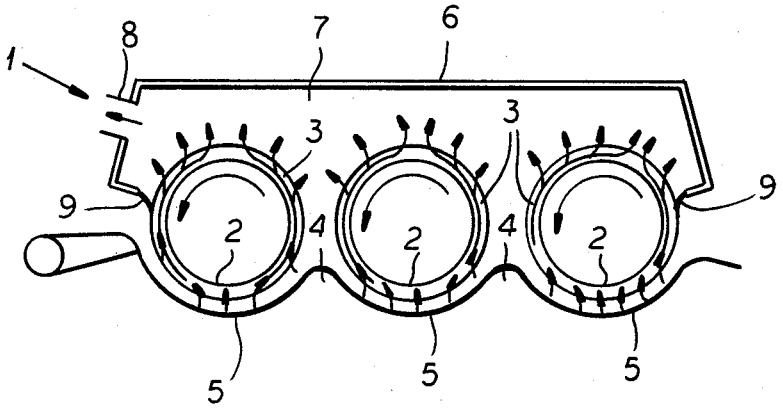
FIG. 3 is a cross section through a mangle consisting of several pressing troughs and hollow rollers.

When the trough mangle 1 according to FIG. 3 has several hollow rollers 2 and trough-shaped hollow bodies 4, it is suitable to provide a single hood 6 which encompasses all the hollow cylinders 2 and accordingly also only one exhaust connection. In this case, the seal 9 is mounted suitably only at the entrance side of the first hollow cylinder 2 or the feeding conveyor and at the exit side of the last hollow cylinder 2 or the discharge conveyor.

Advantageously, the exhaust connections 8 are mounted at the entrance side of the hood 6. This answers a countercurrent motion between the piece of laundry 11 and the absorption flow 12. The steam generated during the drying of the piece of laundry 11 appears first as saturated steam. In the course of the flow 12, this saturated steam gets heated through its contact with the exposed metal parts and reaches the area of the exhaust connection 8 as an energy source of high value, ready for utilization.

Figure 4:
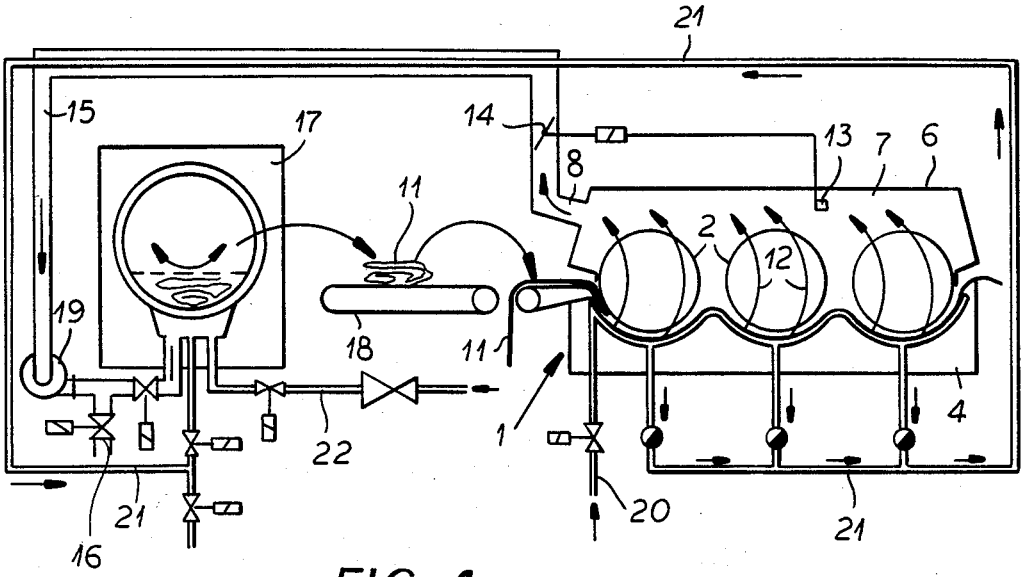
FIG. 4 is an illustration of the connected arrangement of mangle and washing machine.

FIG. 4 shows in this context an advantageous embodiment for the said energy utilization. A washing machine 17, which needs energy and heat for its washing operation, is connected via a conveyor 18 with the mangle 1 which in this instance has three rollers 2. The spread piece of laundry 11 is fed through the sealed feeding slot 9 of the mangle 1. The saturated steam collected during mangling is concentated in the hood 6 and therefrom absorbed in a counterflow and exhausted at 8 in a superheated condition.

Figure 5:
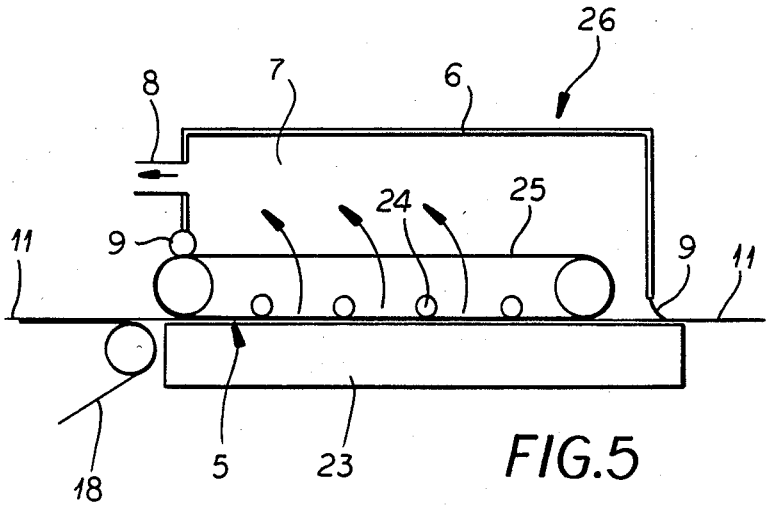
FIG. 5 is an illustration of a flat press to stress the application of the invention to other laundry processing machines.

FIG. 5 shows an alternative to the embodiment of FIGS. 1, 2 and 3. The drying process according to the invention is suited not only for mangles, but generally for contact drying. FIG. 5 shows a contact press 26 which has a level heating plate 23, against which the laundry piece 11 is pressed with the aid of a belt conveyor 25 and several pressure rollers 24. The contact press 26 is surrounded on the outside by the hood 6, whose inner space 7 is secured against air infiltration by seals 9. In this embodiment, as well as in the aforedescribed embodiments, it is normal to seal the hood not only in the direction of the conveyor, but also laterally, for instance against the hollow body 4 or the heating plate 23. The belt conveyor 25 has clearances through which the steam resulting from the piece of laundry can escape to the inner space 7 of the hood and from there through the exhaust connections 8.

It is possible to create many variations of the contact press 26. For instance it is possible to build the heating plate 23 as a convex arch, whereby the pressure rollers 24 can be eliminated. The same situation can occur in the case of so-called ironing press, in which a padded cushion similar to the roller wrapping 3 (FIGS. 1 and 3) is positioned against the piece of laundry and presses it against a heating plate of any desired shape.

FIG. 5 also shows a variation of the seals 9. The left side seal of the hood 6 is built as a roll seal which is pressed against the return pulley of the belt conveyor 25. The roll seal consists of a flexible or removably pivoted sealing roll, which is especially advantageous when mounted at the entrance side of the mangle or another type of contact press. This way it is possible also to position the roll seal against the return pulley of the feeding conveyor 18 (in FIG. 5) and to lift it shortly when a laundry piece comes in.

Such a roll seal can also be mounted at the exit side of the machine. In FIG. 5 a lip seal 9, different from the seals shown in FIGS. 1 to 3, is mounted at the exit side of the contact press 26. This lip seal positions itself against the piece of laundry 11, respectively the heating plate 23.

The sealing of hood 6 on all sides leads to the fact that its inner space during mangling, ironing, pressing or the like is essentially filled only with steam. The steam arriving at the exhaust connections 8 is an energy carrier of high value, which should be utilized with the purpose of energy savings. The prior art uses the steam absorbed through the shaft of the roller for preheating the air fed to the mangle bed. This measure, as aforementioned, is based on the concept that extra air has to be supplied for mangling, does not give satisfactory energy savings.

FIG. 4 shows the heat recovery process according to the invention and the related equipment. From a washer 17 the wet laundry 11 is discharged onto a conveyor 18 and is mechanically wrung, in this instance by a device not represented in the drawing. From the conveyor 18 the laundry piece 11 passes over a known type of feeding conveyor into the mangle 1. The mangle 1 can obviously also be an ironing machine, a press or the like. The steam generated in the inner space 7 of the sealed hood 6 reaches the exhaust connection 8 through a duct 15. In this duct 15 a separator not shown in the drawing can be mounted, which separates the steam from possibly entrained air. Further in the path of the duct 15 a compressor or a high-pressure blower 19 is mounted which feeds the steam further through the duct and compresses it into the washing fluid of the washing machine 17. For the start-up of the installation when no laundry is mangled, pressed or ironed, and no steam is yet available a disconnectable fresh-steam duct 22 is provided which discharges into the washing fluid. As soon as enough steam is available in the hood 6 this fresh-steam duct 22 is disconnected.

During the operation of such a washing installation there can be variations in the feeding rate. In such a case, there can be for instance too little laundry or no laundry pieces 11 at all in the mangle 1 and therefore only little or no steam is generated in the hood 6. The compressor, respectively the blower 19 exhausts at the same power, creating thereby a negative pressure in the inner hood space 7, leading to an undesirable supply of infiltrated air. As aforementioned in the description of FIGS. 1 to 3, it is the purpose of the hood seal to create in the inner space 7 of the hood a pressure at least equal or slightly higher than the one outside the hood 6. In order to be able to automatically control the steam absorption with respect to the available amount of steam, a pressure sensor 13 is provided in the inner space 7 of the hood which monitors the inner pressure and in case this drops below an established level activates the damper 14 in the feeding duct 15 and reduces thereby the existing suction pressure. Instead of the damper 14, the compressor, respectively blower 19 can be controlled. As soon as the inner hood pressure rises again due to a supply of laundry, the exhaust pressure is automatically raised.

In order to ensure the heating of the washing fluid while the mangle 1 supplies insufficient steam the embodiment of FIG. 4 provides, in addition to the fresh-steam duct 22 another auxiliary device, which can be mounted instead or parallel to the fresh-steam duct 22. The heating of the trough-shaped shaped hollow body 4, respectively of a heating plate of different shape, takes place in this case in the presence of high-pressure steam supplied from an external boiler, not shown, via a steam duct 20. With such a high-pressure steam heating system condensate is produced at a temperature of 180° C., for instance, which is evacuated via a condensate pipe 21. Through pressure drop and exterior cooling a condensate having an approximate temperature of 100° C. is produced here. The condensate pipe 21 can be now discharged directly in the washing machine 17 and serve for the heating of the washing fluid. In addition, this condensate pipe 21 is led into or around the supply duct 15, whereby the condensate yields heat to the low-pressure steam in the hood 6. This way, an additional heating of the low-pressure steam in the case of insufficient amounts of laundry in the mangle is obtained. On the other hand, this also prevents the condenation of possible residual steam in the anyway isolated duct 15. The feeding duct 15 also has an outlet 16 for the evacuation of water, when necessary.

In connection with the heat recovery, it is advisable to build the sealed hood 6, already described in the embodiments of FIGS. 1 to 3 and 5, as large as possible. This has the advantage that in the case of variations in the supply rate with laundry pieces, the large inner space 7 of the hood works as a buffer for the evacuation of the steam and prevents a too frequent adjustments of the existing exhaust pressure.

In the hood 6 a closable ventilation damper (not shown) is mounted, which is opened soon before the mangle or ironing press or the like is shut down. This air supply together with the blower 19 still in operation allows for a complete evacuation of the steam contained in the hood 6, which otherwise would form into a condensate and drop down in the mangle. Obviously, during normal operation this ventilation damper is closed in an airtight manner.

I claim:

1. A method of mangling wet laundry which comprises the steps of:

closely juxtaposing a heated trough-shaped surface with a portion of the periphery of a roller covered with a steam-permeable wrapping;

rotating said roller to draw said wet laundry along said surface while pressing said wet laundry with said wrapping against said surface whereby steam is genrated by the contact of said surface with said wet laundry, said steam penetrating into the wrapping of said roller;

sealingly enclosing at least most of the balance of the periphery of said roller in a hood and evacuating said hood to withdraw steam penetrating into said hood through said wrapping upon generation by contact of said wet laundry with said surface; and substantially completely excluding ambient air from penetrating into said hood while evacuating steam therefrom by maintaining the pressure in the hood at a pressure equal to or only slightly above ambient pressure whereby the steam evacuated from said hood is substantially free from air.

2. The method defined in claim 1, further comprising the step of directly injecting steam evacuated from said hood into a washing liquid to heat said washing liquid, and washing laundry to be subsequently mangled between said roller and said surface with the thus heated washing liquid.

3. An apparatus for mangling wet laundry, comprising:

at least one mangling roller rotatable about its axis and covered with a steam-permeable pressing wrapping;

a trough formed with a heated surface closely juxtaposed with a portion of the circumference of said roller whereby wet laundry is entrained upon rotation of said roller between said wrapping and said surface and is pressed while steam is generated by the heating of said laundry by said surface, said steam penetrating into said wrapping;

a hood closing substantially the remainder of the circumference of said roller and provided with exhaust means maintaining the pressure in said hood equal to or only slightly above ambient pressure for drawing off steam from said hood; and seal means between said hood and said wrapping for excluding the incursions of air into said hood while permeating steam penetrating through the wrapping to be drawn off by said hood substantially free from the incursions of ambient air.

4. The apparatus defined in claim 3 wherein a plurality of such rollers each having a respective wrapping and juxtaposed with a heated surface of a respective trough are encompassed by said hood.

5. The apparatus defined in claim 4 wherein said rollers define a path for said laundry from an input side to an output side, said hood being provided with an exhaust device at said input side.

6. An apparatus for mangling wet laundry, comprising:

at least one mangling roller rotatable about its axis and covered with a steam-permeable pressing wrapping;

a trough formed with a heated surface closely juxtaposed with a portion of the circumference of said roller whereby wet laundry is entrained upon rotation of said roller between said wrapping and said surface and is pressed while steam is generated by the heating of said laundry by said surface, said steam penetrating into said wrapping;

a hood closing substantially the remainder of the circumference of said roller and provided with exhaust means for drawing off steam from said hood; and seal means between said hood and said wrapping for excluding the incursions of air into said hool while permeating steam penetrating through the wrapping to be drawn off by said hood substantially free from the incrusions of ambient air, said sealing means including at least one sealing lip bearing against said wrapping.

7. An apparatus for mangling wet laundry, comprising:

at least one mangling roller rotatable about its axis and covered with a steam-permeable pressing wrapping;

a trough formed with a heated surface closely juxtaposed with a portion of the circumference of said roller whereby wet laundry is entrained upon rotation of said roller between said wrapping and said surface and is pressed while steam is generated by the heating of said laundry by said surface, said steam penetrating into said wrapping;

a hood closing substantially the remainder of the circumference of said roller and provided with exhaust means for drawing off steam from said hood; and seal means between said hood and said wrapping for excluding the incursions of air into said hool while permeating steam penetrating through the wrapping to be drawn off by said hood substantially free from the incursions of ambient air;

means for injecting steam withdrawn by said hood from said wrapping into a washing liquid and for introducing said washing liquid into a washing machine, said means including a compressor; and a pressure sensor in said hood and a damper controlled by said pressure sensor between said hood and said washing machine.

8. The apparatus defined in claim 7 wherein the last mentioned means includes a compressor.

9. The apparatus defined in claim 8, further comprising a pressure sensor in said hood and a damper controlled by said pressure sensor between said hood and said washing machine.

10. The apparatus defined in claim 8, further comprising a fresh steam duct for introducing fresh steam into washing liquid in said washing machine.

11. The apparatus defined in claim 8 wherein said surface is heated by steam, further comprising means for recovering condenstate from said trough and delivering to said washing machine as part of said washing liquid.

12. The apparatus defined in claim 11 wherein the last mentioned means includes a condensate pipe and said hood is connected to said washing machine by a steam duct, said duct and said condensate pipe being at least partially in exchanging contact with one another.

13. The apparatus defined in claim 8 wherein said hood is provided with a closable airtight ventilation damper.

14. An apparatus for washing and mangling laundry which comprises:

a washing machine supplied with a washing liquid;

a mangle for receiving laundry from said washing machine, said mangle including:

at least one roller provided with a steam-permeable pressing wrapping, a trough closely juxtaposed with a portion of the circumference of said roller and having a heated surface juxtaposed with said wrapping whereby rotation of said roller entrains wet laundry between said wrapping and said surface to press said laundry against said surface and generate steam which penetrates into said wrapping, and a hood extending over substantially all of the balance of said circumference and sealed with respect to said wrapping whereby said hood collects steam pressing through said wrapping while excluding ambient air therefrom;

a duct connecting said hood with said washing machine for introducing said steam into said washing liquid, said duct including means for evacuating said steam from said hood, said surface being heated with steam introduced into said trough whereby condensate is formed from the heating steam; and a condensate-collecting pipe connected to said trough and in heat-exchanging relationship with said duct for introducing collected condensate into said washing machine as part of said washing liquid.

15. The apparatus defined in claim 14 wherein said duct is provided with a damper controlled by said pressure sensor in said hood.

16. The apparatus defined in claim 15, further comprising means between said washing machine and said mangle for transferring wet laundry from said washing machine to said mangle.

17. A method of pressing wet laundry which comprises the steps of:

closely justaposing a heated surface with a steam-permeable wrapping;

pressing said wet laundry against said surface with said wrapping whereby steam is generated by the contact of said surface with said wet laundry, said steam penetrating into the wrapping;

sealingly justaposing said wrapping with a hood and evacuating said hood to withdraw steam penetrating into said hood through said wrapping upon generation by contact of said wet laundry with said surface; and substantially completely excluding ambient air from penetrating into said hood while evacuating steam therefrom by maintaining the pressure in the hood at a pressure equal to or only slightly above ambient pressure whereby the steam evacuated from said hood is substantially free from air.

* * * * *